US011209249B2

(12) United States Patent
Rhodes et al.

(10) Patent No.: US 11,209,249 B2
(45) Date of Patent: Dec. 28, 2021

(54) METHODS TO IMPROVE BURST UNIFORMITY AND EFFICIENCY IN EXPLODING FOIL INITIATORS

(71) Applicant: LAWRENCE LIVERMORE NATIONAL SECURITY, LLC, Livermore, CA (US)

(72) Inventors: Mark Rhodes, Pleasanton, CA (US); Chadd M. May, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 82 days.

(21) Appl. No.: 16/639,974

(22) PCT Filed: Aug. 17, 2018

(86) PCT No.: PCT/US2018/046973
§ 371 (c)(1),
(2) Date: Feb. 18, 2020

(87) PCT Pub. No.: WO2019/152073
PCT Pub. Date: Aug. 8, 2019

(65) Prior Publication Data

US 2020/0191536 A1 Jun. 18, 2020

Related U.S. Application Data

(60) Provisional application No. 62/547,960, filed on Aug. 21, 2017.

(51) Int. Cl.

| | |
|---|---|
| ***F42B 3/12*** | (2006.01) |
| ***F42B 3/11*** | (2006.01) |
| ***F42C 19/12*** | (2006.01) |

(52) U.S. Cl.
CPC ..... *F42B 3/124* (2013.01); *F42B 3/121* (2013.01); *F42B 3/127* (2013.01); *F42B 3/11* (2013.01); *F42B 3/128* (2013.01); *F42C 19/12* (2013.01)

(58) Field of Classification Search
CPC ..... F42C 19/12; F42C 9/08; F42B 3/124
See application file for complete search history.

(56) References Cited

U.S. PATENT DOCUMENTS 4,788,913 A * 12/1988 Stroud ..... F42B 3/11 102/202.5
5,969,286 A * 10/1999 Ward ..... F42B 3/124 102/202.14

(Continued)

FOREIGN PATENT DOCUMENTS

CN 105627841 A * 6/2016

OTHER PUBLICATIONS

English translation of CN-105627841-A (Year: 2016).*

(Continued)

*Primary Examiner* — Joshua T Semick
(74) *Attorney, Agent, or Firm* — Eddie E. Scott

(57) ABSTRACT

Exploding foil initiator apparatus, system, and method that improve the current density in the bridge region by modifying the shape and dimensions of the bridge and related components. The exploding foil initiator reduces burn-back by making areas of the bridge thicker except directly under the flyer. The exploding foil initiator boards are built so the flyer is not connected to the rest of the top cover-lay. This avoids losing energy due to the flyer having to tear away from the solid cover-lay.

16 Claims, 3 Drawing Sheets

(56) References Cited

U.S. PATENT DOCUMENTS

| | | | | |
|---|---|---|---|---|
| 6,133,146 | A * | 10/2000 | Martinez-Tovar | F42B 3/13 438/656 |
| 6,234,081 | B1 | 5/2001 | Neyer | |
| 6,470,802 | B1 * | 10/2002 | Neyer | F42B 3/124 102/202.5 |
| 8,573,122 | B1 | 11/2013 | Nance et al. | |
| 8,746,144 | B2 | 6/2014 | Givens et al. | |
| 2009/0151584 | A1 | 6/2009 | Desai | |

OTHER PUBLICATIONS

International Search Report and Written Opinion for PCT/US2018/046973 corresponding to U.S. Appl. No. 16/639,974, 10 pages.

* cited by examiner

METHODS TO IMPROVE BURST UNIFORMITY AND EFFICIENCY IN EXPLODING FOIL INITIATORS

CROSS-REFERENCE TO RELATED APPLICATIONS

This application claims priority to and benefit under 35 U.S.C. § 119(e) of U.S. Provisional Patent Application No. 62/547,960, filed Aug. 21, 2017, entitled "Methods to Improve Burst Uniformity and Efficiency in Exploding Foil Initiators," the content of which is hereby incorporated by reference in its entirety for all purposes.

STATEMENT AS TO RIGHTS TO APPLICATIONS MADE UNDER FEDERALLY SPONSORED RESEARCH AND DEVELOPMENT

The United States Government has rights in this application pursuant to Contract No. DE-AC52-07NA27344 between the United States Department of Energy and Lawrence Livermore National Security, LLC for the operation of Lawrence Livermore National Laboratory.

BACKGROUND

Field of Endeavor

The present application relates to initiators and more particularly to an exploding foil initiator.

State of Technology

This section provides background information related to the present disclosure which is not necessarily prior art.

Exploding foil initiators (EFI's) are used to detonate high explosives. To date, EFI's have been designed by selecting the length, width, and thickness of a metallic foil to match the output properties of a particular electrical pulse generator. These pulse generators are often called Firesets and/or Capacitive Discharge Units (CDU's). The foil dimensions are chosen so that the foil bursts near the peak of the Fireset current pulse. The time frame for these current pulses and foil "time to burst" are typically on the order of just a few microseconds (millionths of a second). At very slow or DC time frames, current will uniformly fill a conductor so the current density in the conductor will be uniform. Any heating due to this current will also be uniform. However, at microsecond time frames, electromagnetic effects may act to make current density in EFI's nonuniform. The inventors expected that the heating and bursting of the EFI will also be nonuniform and the inventor's recent experimental observations of EFI's in operation do in fact show this to be the case.

U.S. Pat. No. 7,581,496 for Exploding foil initiator chip with non-planar switching capabilities, patented Sep. 1, 2009, includes the state of technology information reproduced below.

"Initiators utilizing exploding foil initiator (EFI) chips are well known in the art. Briefly, (EFI) chips include a substrate chip (typically a ceramic) onto which a bridge is mounted. The bridge is connected to a power source through two conductive lands or pads or in the alternative a low inductance connection. In a system wherein operation of the exploding foil initiator is initiated by an external trigger (i.e., standard mode operation), the power source can typically be a capacitor whose discharge is governed by a high voltage switch. When the switch closes, the capacitor provides sufficient electric current to convert the bridge from a solid state to a plasma. The pressure of the plasma drives a flyer into contact with an explosive charge, thereby generating a shock wave that can be employed to initiate a desired event (e.g., detonation, deflagration or combustion).

U.S. Pat. No. 7,938,065 for efficient exploding foil initiator and process for making same, patented May 10, 2011, includes the state of technology information reproduced below.

"Initiators are employed in various demanding applications, including airbag activation, munitions detonation, solid rocket motor ignition, aircraft pilot ejection, and so on. Such applications often require relatively safe initiators that do not activate unless a predetermined set of conditions are met."

"Safe initiators are particularly important in munitions applications, where inadvertent activation of an explosive charge can be devastating. For the purposes of the present discussion, an initiator may be any device or module that initiates or starts an action in response to a predetermined signal or sensed condition. An actuator may be anything that causes or performs an action when activated. Munitions that are equipped with relatively safe initiators are often called insensitive munitions. Ideally, insensitive munitions will not explode, even in a fire, unless desired conditions are met."

"Insensitive munitions are often equipped with Exploding Foil Initiators (EFIs). An example EFI includes a silicon substrate with an exploding foil, often called a bridge, coupled between two electrodes, called lands. A flyer is positioned on the bridge and near an explosive charge. A barrel may act as a spacer between the foil and the explosive charge. A fireset is coupled to the electrodes. When certain desired conditions are met, the fireset applies a high voltage pulse to the electrodes sufficient to explode the foil. The exploding foil propels the flyer into the explosive charge at sufficiently high velocities to detonate the explosive charge."

SUMMARY

Features and advantages of the disclosed apparatus, systems, and methods will become apparent from the following description. Applicant is providing this description, which includes drawings and examples of specific embodiments, to give a broad representation of the apparatus, systems, and methods. Various changes and modifications within the spirit and scope of the application will become apparent to those skilled in the art from this description and by practice of the apparatus, systems, and methods. The scope of the apparatus, systems, and methods is not intended to be limited to the particular forms disclosed and the application covers all modifications, equivalents, and alternatives falling within the spirit and scope of the apparatus, systems, and methods as defined by the claims.

The inventors' exploding foil initiator apparatus, systems, and methods provide greatly improve the current density uniformity in EFI's. The inventors' method in combination with other, improved fabrication methods improves the overall EFT performance and efficiency. The inventors' method relies on modifying the shape of the conductors used in the EFI and produces a dramatic improvement in the current density uniformity which in turn improves efficiency. The improvement in current density and subsequent improvement in EFI performance allows more efficient, lower total energy EFI systems to be designed and deployed for various high explosive applications.

The inventors' exploding foil initiator apparatus, systems, and methods improve the current density in the bridge region by modifying the shape and dimensions of the bridge and related components. The inventors' exploding foil initiator apparatus, systems, and methods reduce burn-back by choosing the dimensions of all areas of conductor other than directly under the flyer to be thicker so that these other regions do not vaporize or melt. In one embodiment, the inventory build the boards so the flyer is not connected to the rest of the top coverlay. This avoids losing energy due to the flyer having to tear away from the solid coverlay used in prior art designs. While in another embodiment a continuous coverlay is employed and the flyer section is not slit form the remainder of the coverlay.

Using electromagnetic modeling tools, the inventors discovered they could make a substantial improvement in the current density uniformity by modifying the shape and dimensions of the bridge and bottom side return path of the EFI board. The inventors provide new shapes and dimensions for the bridge, bottom-side return path, and related components to illustrate the concept and action of the invention. Many other shapes are possible depending on the desired results.

The inventors' exploding foil initiator apparatus, systems, and methods can be used to improve the performance, reliability, and potentially reduce the cost of any high explosive initiation system based on an EFI.

The apparatus, systems, and methods are susceptible to modifications and alternative forms. Specific embodiments are shown by way of example. It is to be understood that the apparatus, systems, and methods are not limited to the particular forms disclosed. The apparatus, systems, and methods cover all modifications, equivalents, and alternatives falling within the spirit and scope of the application as defined by the claims.

BRIEF DESCRIPTION OF THE DRAWINGS

The accompanying drawings, which are incorporated into and constitute a part of the specification, illustrate specific embodiments of the apparatus, systems, and methods and, together with the general description given above, and the detailed description of the specific embodiments, serve to explain the principles of the apparatus, systems, and methods.

DETAILED DESCRIPTION OF SPECIFIC EMBODIMENTS

Figure 1:
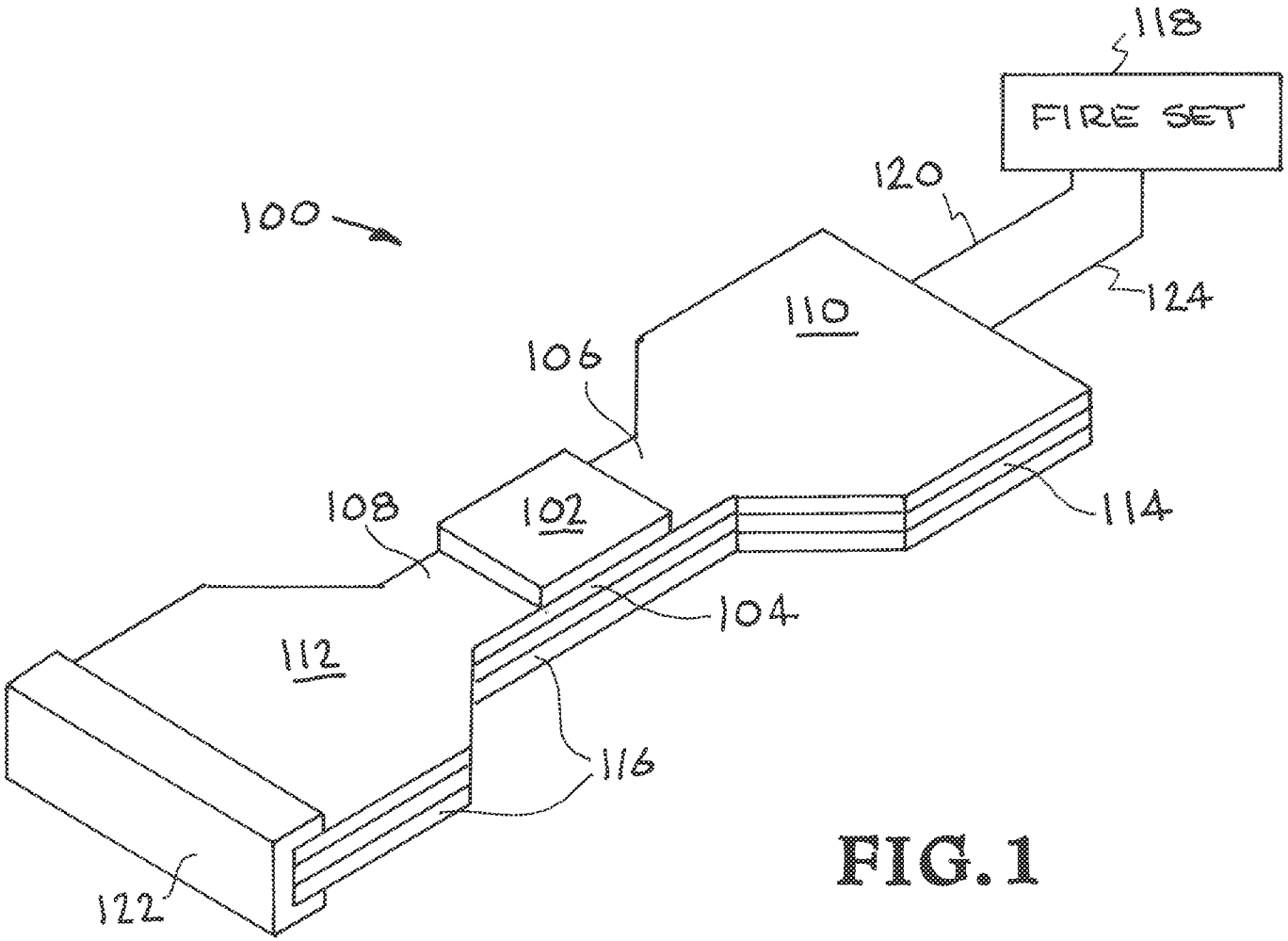
FIG. 1 illustrates one embodiment of an exploding foil initiator incorporating the inventors' apparatus, systems, and methods.

Referring to the drawings, to the following detailed description, and to incorporated materials, detailed information about the apparatus, systems, and methods is provided including the description of specific embodiments. The detailed description serves to explain the principles of the apparatus, systems, and methods. The apparatus, systems, and methods are susceptible to modifications and alternative forms. The application is not limited to the particular forms disclosed. The application covers all modifications, equivalents, and alternatives falling within the spirit and scope of the apparatus, systems, and methods as defined by the claims.

Exploding Foil Initiators (EFI's) are widely used to initiate detonation of secondary high explosives without the use of Low Energy Initiators that contain sensitive, primary, high-explosives. An EFI is operated by passing a high-current electrical pulse through a section of metal foil. The magnitude and duration of this current pulse is, by design, sufficient to heat the metallic foil to the point of rapid vaporization through ohmic heating. The bursting foil in turn accelerates a thin layer of plastic (often called a "flyer") which in turn impacts the high explosive and causes detonation. In the ideal case, the entire foil is uniformly heated and vaporizes uniformly across its entire surface area. Uniform heating requires uniform current density in the bursting section of foil. However, our experiments and modeling of typical EFI's show that, due to the physical design of the EFI boards, the current density in the foil is not uniform. The foil does not burst uniformly and the flyer is not accelerated uniformly or efficiently.

Referring now to the drawings, and in particular to FIG. 1, one embodiment of an exploding foil initiator incorporating the inventors' apparatus, systems, and methods is illustrated. This first embodiment is designated generally by the reference numeral 100. As illustrated, the embodiment 100 includes a number of components. The components of the inventor's apparatus, systems, and methods 100 illustrated in FIG. 1 are identified and described below.

Reference Numeral 102—flyer
Reference Numeral 104—bridge
Reference Numeral 106—first bridge extension
Reference Numeral 108—second bridge extension
Reference Numeral 110—first upper electrical conductor portion
Reference Numeral 112—second upper electrical conductor portion
Reference Numeral 114—insulator
Reference Numeral 116—lower conductor/ground
Reference Numeral 118—fireset
Reference Numeral 120—upper electrical lead to fireset
Reference Numeral 122—jumper
Reference Numeral 124—lower electrical lead to fireset.

The description of the components of the inventors' exploding foil initiator apparatus, systems, and methods 100 illustrated in FIG. 1 having been completed, the operation and additional description of the inventors first embodiment apparatus, systems, and methods will now be considered in greater detail.

As illustrated in FIG. 1, the inventor's apparatus, systems, and methods 100 provide an exploding foil initiator having a bridge 104, a first bridge extension 106, a second bridge extension 108, a first upper electrical conductor portion 110, a second upper electrical conductor portion 112, a lower conductor/ground 116; an insulator 114 between the bridge 104 and the lower conductor/ground 116. A jumper connects the second upper electrical conductor portion 112 to the lower conductor/ground 116. An upper electrical lead 120 is connected to the first upper electrical conductor portion 110. A lower electrical lead 124 is connected to the lower conductor/ground 116. A fireset 118 is connected to the upper electrical lead 120 and to the lower electrical lead 124. A flyer 102 is located on the bridge 104.

The inventors' apparatus, systems, and methods 100 provide a method to greatly improve the current density uniformity in EFI's. This method in combination with other, improved fabrication methods improves the overall EFI performance. The inventors' method relies on modifying the shape of the conductors used in the EFI and produces a dramatic improvement in the current density uniformity. The improvement in current density and subsequent improvement in EFI performance allows more efficient, lower total energy EFI systems to be designed and deployed for various high explosive applications.

Figure 2:
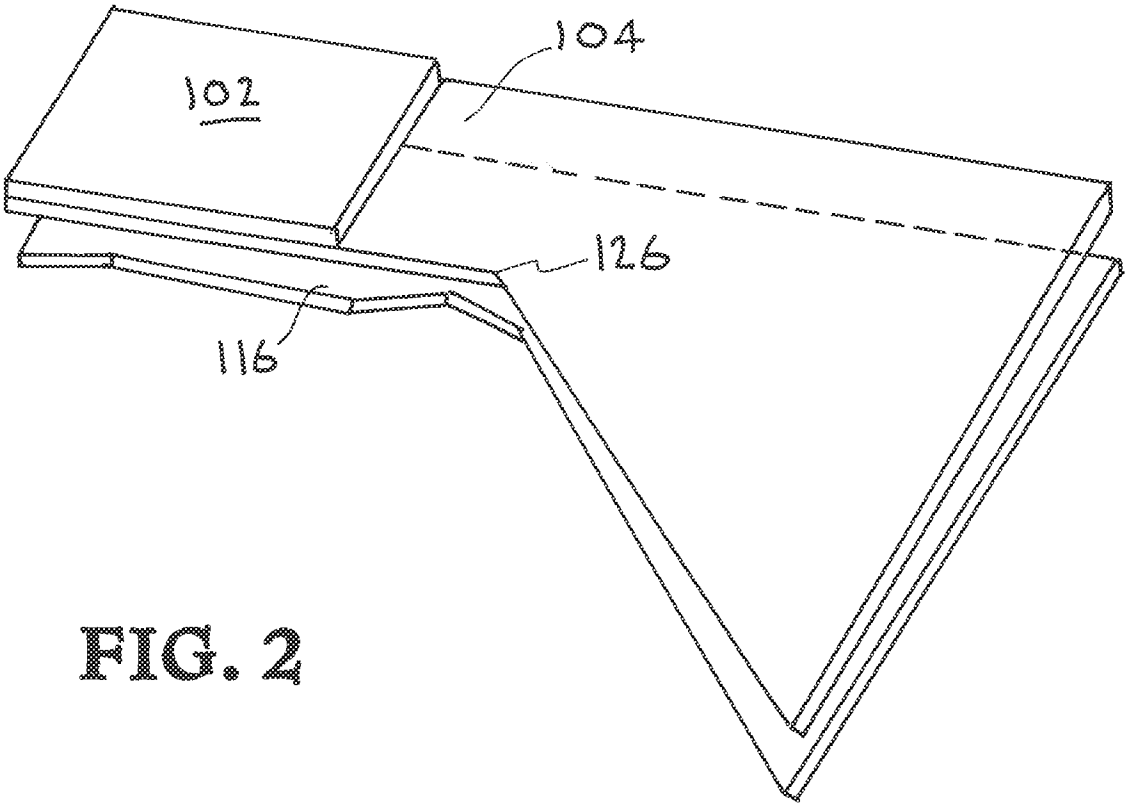
FIG. 2 is an enlarged portion of the exploding foil initiator shown in FIG. 1 providing more details of the inventors' exploding foil initiator apparatus, systems, and methods.

Referring now to FIG. 2, an enlarged portion of the exploding foil initiator shown in FIG. 1 is provided giving more details of the inventors' exploding foil initiator apparatus, systems, and methods. As illustrated in FIG. 2, an important change is the shape of the bottom ground return 116. The shape was determined using Ansys Electromagnetics FEA modeling code and hundreds of runs. As illustrated in FIG. 2, changes to the shape and dimensions of the bottom ground return 116 produce a uniform current density in the bridge 104.

Another change is illustrated in FIG. 2. It changes the shape and dimensions of the bridge 104 to allow the flyer 102 to be intact when the flyer 102 leaves the bridge 104. The top is changed by pulling the taper back from the bridge region. This moves the corners away from the bridge region. The corners 126 are moved away from the flyer/bridge region. These corners are seen to be points of high current density even with modifications to the lower ground conductor 116. Moving them away from the bridge 104 further improves the current density in 104.

Figure 3:
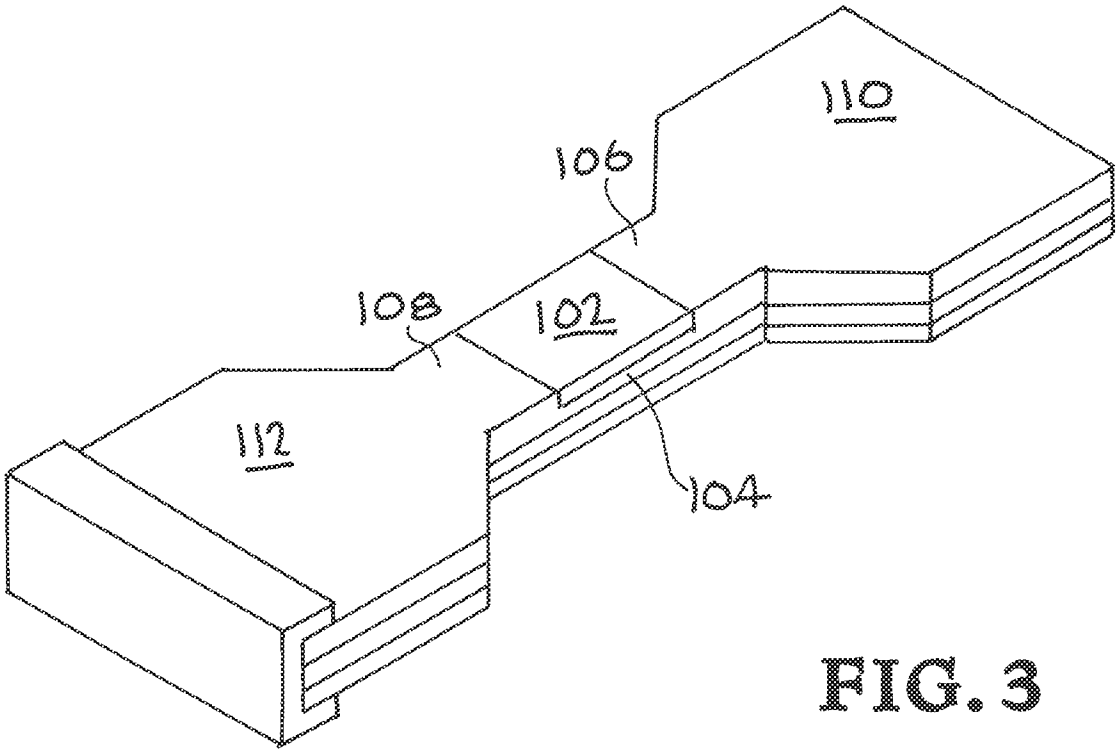
FIG. 3 is an illustration of the exploding foil initiator shown in FIG. 1 providing more details of the inventors' exploding foil initiator apparatus, systems, and methods of FIGS. 1 and 2.

Referring now to FIG. 3, an illustration of the exploding foil initiator provides more details of the inventors' exploding foil initiator apparatus, systems, and methods. The shape and dimensions of the bridge 104 are chosen such that the portion of the bridge under the flyer 102 is of reduced thickness to efficiently vaporize near the peak of the Fireset current pulse. In addition, the dimensions of bridge extensions 106 and 108 plus all other conductor regions (other than 104) are chosen such that they do not vaporize during the current pulse. As an example, the EFI boards used to demonstrate this invention employed 9 micron copper thickness for 104 and 32 microns for all other copper regions. As shown in FIG. 3, the first upper electrical conductor portion 110 and the second upper electrical conductor portion 112 are both 32 microns while 104, the portion of the bridge under the flyer 102 is only 9 microns. The exact dimensions will always change with the fireset and specific application but region 104 will always be thinner than the other conductor regions.

Referring, again to FIG. 3, the exploding foil initiator apparatus includes the bridge having a bridge shape and bridge dimensions and a flyer on the bridge. A current return path unit is located under the bridge. The bridge has a first side, a second side, a bridge shape, and bridge dimensions. A first extension of the bridge is located on the first side. A second extension of the bridge is located on the second side. A fireset is connected to the bridge through the first extension and the second extension. The fireset produces a current density in the bridge. The bridge shape, bridge dimensions, and the current return path unit produce a uniform current density in the bridge.

The fireset produces an applied current pulse having a peak of applied current, wherein the bridge shape and bridge dimensions are chosen such that an optimized burst of said bridge occurs at the peak of the applied current. The bridge has a melt temperature wherein the bridge shape and the bridge dimensions are chosen to stay below the melt temperature when the fireset produces the current density in the bridge.

Some of the advantages of the inventors' exploding foil initiator apparatus, systems, and methods 100 include: (1) improving the current density in the bridge region by modifying the shape of both the top and bottom copper traces, (2) reducing burn-back by making all areas of the copper thick enough to not melt except directly under the flyer (104), (3) building the boards so the flyer is either not connected to the rest of the top cover-lay or in another embodiment the coverlay is not cut over region 104, and (3) the inventors used electromagnetic modeling tools and found they could make a substantial improvement in the current density uniformity by modifying the shape of the copper on both sides of the EFI board.

Although the description above contains many details and specifics, these should not be construed as limiting the scope of the application but as merely providing illustrations of some of the presently preferred embodiments of the apparatus, systems, and methods. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present application fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present apparatus, systems, and methods, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

While the apparatus, systems, and methods may be susceptible to various modifications and alternative forms, specific embodiments have been shown by way of example in the drawings and have been described in detail herein. However, it should be understood that the application is not intended to be limited to the particular forms disclosed. Rather, the application is to cover all modifications, equivalents, and alternatives falling within the spirit and scope of the application as defined by the following appended claims.

Broadly, this writing discloses at least the following: Exploding foil initiator apparatus, system, and method that improve the current density in the bridge region by modifying the shape and dimensions of the bridge and related components. The exploding foil initiator reduces burn-back by making areas of the bridge thicker except directly under the flyer. The exploding foil initiator boards are built so the flyer is not connected to the rest of the top cover-lay. This avoids losing energy due to the flyer having to tear away from the solid cover-lay.

CONCEPTS

This writing also presents at least the following concepts:

1. An exploding foil initiator apparatus, comprising:

a bridge, said bridge having a first side, a second side, a bridge shape, and bridge dimensions;

a first extension of said bridge on said first side;

a second extension of said bridge on said second side;

a flyer on said bridge;

a current return path unit under said bridge; and a fireset connected to said first extension of said bridge, said second extension of said bridge, and said bridge;

wherein said fireset produces a current density in said bridge; and wherein said bridge shape, said bridge dimensions, and said current return path produce a uniform current density in said bridge.

2. The exploding foil initiator apparatus of concept 1 wherein said fireset produces an applied current pulse having a peak of applied current, and wherein said bridge shape and said bridge dimensions are chosen such that an optimized burst of said bridge occurs at said peak of the applied current.

3. The exploding foil initiator apparatus of concepts 1 and 2 wherein said bridge has a melt temperature and wherein said bridge shape and said bridge dimensions are chosen to stay below said melt temperature when said fireset produces a current density in said bridge.

4. The exploding foil initiator apparatus of concepts 1, 2, and 3 further comprising a ground return conductor beneath said bridge wherein said ground return conductor is patterned to produce uniform current density in said bridge.

5. A method of making an exploding foil initiator, comprising the steps of:

providing a bridge having a first side, a second side, a bridge shape, and bridge dimensions;

providing a first extension of said bridge on said first side;

providing a second extension of said bridge on said second side;

positioning a flyer on said bridge; and connecting a fireset to said first extension of said bridge, said second extension of said bridge, and said bridge that produces a current density in said bridge;

wherein said bridge shape and said bridge dimensions produce a uniform current density in said bridge.

6. The method of making an exploding foil initiator of concept 5 wherein said step of connecting a fireset to said first extension of said bridge, said second extension of said bridge, and said bridge that produces a current density in said bridge provides a peak of applied current pulse, and further comprising the step of selecting said bridge shape and bridge dimensions under said flyer that will enable said bridge to burst near said peak of applied current pulse.

7. The method of making an exploding foil initiator of concepts 5 and 6 further comprising the step of providing said shape and said dimensions of said bridge that allows said flyer to be intact when said flyer leaves said bridge.

8. The method of making an exploding foil initiator of concepts 5, 6, and 7 further comprising the step of providing a ground return conductor beneath said bridge wherein said ground return conductor is patterned to produce uniform current density in said bridge.

9. An exploding foil initiator apparatus, comprising:

electrical conductors that include a first upper electrical conductor portion, a bridge, a first extension of said bridge, and a second extension of said bridge;

a second upper electrical conductor portion;

a lower ground electrical conductor;

an insulator between said upper electrical conductor and said lower ground electrical conductor;

a jumper that connects said second upper electrical conductor portion to said lower ground electrical conductor;

an upper electrical lead connected to said first upper electrical conductor portion;

a lower electrical lead connected to said lower ground electrical conductor;

a flyer on said bridge; and a fireset connected to said upper electrical lead and to said lower electrical lead.

10. The exploding foil initiator apparatus of concept 9, wherein said bridge has a bridge shape and bridge dimensions that produce a uniform current density in said bridge.

11. The exploding foil initiator apparatus of concepts 9 and 10, wherein said first extension of said bridge has a greater thickness than said bridge, and wherein said second extension of said bridge has a greater thickness than said bridge, 12. The exploding foil initiator apparatus of concepts 9, 10, and 11 further comprising patterning on said lower ground electrical conductor.

13. A method of making an initiator, comprising the steps of:

providing an upper electrical conductor that includes a first upper electrical conductor portion, a bridge, a first extension of said bridge, a second extension of said bridge, and a second upper electrical conductor portion wherein said bridge has a bridge shape and bridge dimensions, providing a lower ground electrical conductor;

providing an insulator between said upper electrical conductor and said lower ground electrical conductor;

providing a jumper that connects said second upper electrical conductor portion to said lower ground electrical conductor;

providing an upper electrical lead connected to said first upper electrical conductor portion;

providing a lower electrical lead connected to said lower ground electrical conductor;

providing a flyer on said bridge; and providing a fireset connected to said upper electrical lead and to said lower electrical lead wherein said bridge shape and said bridge dimensions produce a uniform current density in said bridge.

14. The method of making an exploding foil initiator of concept 13 wherein said step of providing a fireset produces a peak of applied current pulse and wherein said bridge under said flyer will burst near said peak of applied current pulse.

15. The method of making an exploding foil initiator of concepts 13 and 14 further comprising the step of providing said shape and said dimensions of said bridge that allows said flyer to be intact when said flyer leaves said bridge.

16. The method of making an exploding foil initiator of concepts 13, 14, and 15 further comprising the step of providing a ground return conductor beneath said bridge wherein said ground return conductor is patterned to produce uniform current density in said bridge.

The invention claimed is:

1. An exploding foil initiator apparatus, comprising:

a bridge, said bridge having a first side, a second side, a bridge width, a bridge shape, and bridge dimensions;

a first extension of said bridge adjacent said first side that has a first extension width wherein said bridge width and said first extension width are the same;

a second extension of said bridge adjacent said second side that has a second extension width wherein said bridge width and said second extension width are the same;

a first upper electrical conductor portion connected to said first extension of said bridge that has a first electrical conductor width wherein said first electrical conductor width is greater than said bridge width;

a second upper electrical conductor portion connected to said second extension of said bridge that has a second electrical conductor width wherein said second electrical conductor width is greater than said bridge width;

an insulator under said bridge, under said first extension of said bridge on said first side, under said second extension of said bridge on said second side; under said first upper electrical conductor portion connected to said first extension of said bridge, and under said second upper electrical conductor portion;

a lower conductor under said insulator;

a jumper connecting said first upper electrical conductor portion, said second upper electrical conductor portion, said insulator, and said lower conductor;

a flyer on said bridge;

a current path in said bridge; and a fireset connected to said first extension of said bridge and said second extension of said bridge that produces an applied current pulse;

wherein said fireset produces said applied current pulse that produces a current density having a peak of applied current in said current path in said bridge; and wherein said bridge shape, said bridge dimensions, and said current path are such that said peak of applied current occurs in said bridge.

2. The exploding foil initiator apparatus of claim 1 wherein said bridge shape and said bridge dimensions are such that when said peak of applied current occurs in said current path in said bridge and said flyer leaves said bridge said flyer remains intact.

3. The exploding foil initiator apparatus of claim 2 wherein said bridge has a melt temperature and wherein said bridge shape and said bridge dimensions are chosen to stay below said melt temperature when said fireset produces said applied current pulse in said bridge.

4. The exploding foil initiator apparatus of claim 1 wherein said lower conductor under said insulator is patterned to produce uniform current density in said bridge.

5. A method of making an exploding foil initiator, comprising the steps of:

providing a bridge having a first side, a second side, a bridge width, a bridge shape, and bridge dimensions;

providing a first extension of said bridge adjacent said first side that has a first extension width wherein said bridge width and said first extension width are the same;

providing a second extension of said bridge adjacent said second side that has a second extension width wherein said bridge width and said second extension width are the same;

providing a first upper electrical conductor portion connected to said first extension of said bridge that has a first electrical conductor width wherein said first electrical conductor width is greater than said bridge width;

providing a second upper electrical conductor portion connected to said second extension of said bridge that has a second electrical conductor width wherein said second electrical conductor width is greater than said bridge width;

providing an insulator under said bridge, under said first extension of said bridge on said first side, under said second extension of said bridge on said second side; under said first upper electrical conductor portion connected to said first extension of said bridge, and under said second upper electrical conductor portion;

providing a lower conductor under said insulator;

providing a jumper connecting said first upper electrical conductor portion, said second upper electrical conductor portion, said insulator, and said lower conductor;

positioning a flyer on said bridge;

providing a current path in said bridge; and connecting a fireset to said first extension of said bridge and said second extension of said bridge that produces an applied current pulse;

wherein said fireset produces said applied current pulse that produces a current density having a peak of applied current in said current path in said bridge; and wherein said bridge shape, said bridge dimensions, and said current path are such that said peak of applied current occurs in said bridge.

6. The method of making an exploding foil initiator of claim 5 wherein said bridge has a melt temperature and wherein said bridge shape and bridge dimensions are chosen to stay below said melt temperature when said fireset produces a current density having a peak of applied current in said current path in said bridge.

7. The method of making an exploding foil initiator of claim 5 wherein said shape and said dimensions of said bridge are such that they allow said flyer to be intact when said flyer leaves said bridge.

8. The method of making an exploding foil initiator of claim 5 wherein said lower conductor under said insulator is patterned to produce uniform current density in said bridge.

9. An exploding foil initiator apparatus, comprising:

a bridge, said bridge having a first side, a second side, a bridge width, a bridge thickness, a bridge shape, and bridge dimensions;

a first extension of said bridge adjacent said first side that has a first extension width, wherein said bridge width and said first extension width are the same and has a first extension thickness wherein said first extension thickness is greater than said bridge thickness;

a second extension of said bridge adjacent said first side that has a second extension width, wherein said bridge width and said second extension width are the same and has a second extension thickness wherein said second extension thickness is greater than said bridge thickness;

a first upper electrical conductor portion connected to said first extension of said bridge that has a first electrical conductor width wherein said first electrical conductor width is greater than said bridge width;

a second upper electrical conductor portion connected to said second extension of said bridge that has a second electrical conductor width wherein said second electrical conductor width is greater than said bridge width;

an insulator under said bridge, under said first extension of said bridge on said first side, under said second extension of said bridge on said second side; under said first upper electrical conductor portion connected to said first extension of said bridge, and under said second upper electrical conductor portion;

a lower conductor under said insulator;

a jumper that connects said first upper electrical conductor portion, said second upper electrical conductor portion, said insulator, and said lower conductor;

an upper electrical lead connected to said first upper electrical conductor portion;

a lower electrical lead connected to said lower ground electrical conductor;

a current path in said bridge;

a flyer on said bridge; and a fireset connected to said upper electrical lead and to said lower electrical lead that produces a current density having a peak of applied current in said current path in said bridge, wherein said bridge shape, said bridge dimensions, and said current path are such that said peak of applied current occurs in said bridge.

10. The exploding foil initiator apparatus of claim 9, wherein said bridge has a first side, a second side, a bridge width, a bridge thickness, a bridge shape and bridge dimensions that produce a uniform current density in said bridge.

11. The exploding foil initiator apparatus of claim 9, wherein said bridge has a first side, a second side, a bridge width, a bridge thickness, a bridge shape and bridge dimensions that produce a uniform current density in said bridge and wherein said first extension of said bridge has a greater thickness than said bridge, and wherein said second extension of said bridge has a greater thickness than said bridge.

12. The exploding foil initiator apparatus of claim 9, further comprising patterning on said lower conductor.

13. A method of making an initiator, comprising the steps of:

providing an upper electrical conductor that includes a first upper electrical conductor portion, a bridge having a first side, a second side, a bridge width, a bridge shape, and bridge dimensions, a first extension of said bridge that has a first extension width wherein said bridge width and said first extension width are the same, a second extension of said bridge that has a second extension width wherein said bridge width and said second extension width are the same, and a second upper electrical conductor portion;

providing a lower ground electrical conductor;

providing an insulator between said upper electrical conductor and said lower ground electrical conductor;

providing a jumper that connects said second upper electrical conductor portion to said lower ground electrical conductor;

providing an upper electrical lead connected to said first upper electrical conductor portion;

providing a lower electrical lead connected to said lower ground electrical conductor;

providing a flyer on said bridge; and providing a fireset connected to said upper electrical lead and to said lower electrical lead wherein said bridge shape and said bridge dimensions produce a uniform current density in said bridge.

14. The method of making an exploding foil initiator of claim 13 wherein said step of providing a fireset connected to said upper electrical lead and to said lower electrical lead produces a peak of applied current pulse and wherein said bridge under said flyer will burst near said peak of applied current pulse.

15. The method of making an exploding foil initiator of claim 13 wherein said step of applying a bridge includes providing a bridge width, a bridge shape, and bridge dimensions, a first extension of said bridge that has a first extension width wherein said bridge width and said first extension width are the same, a second extension of said bridge that has a second extension width wherein said bridge width and said second extension width are the same;

further comprising the step of providing said shape and said dimensions of said bridge that allows said flyer to be intact when said flyer leaves said bridge.

16. The method of making an exploding foil initiator of claim 13 further comprising the step of providing a ground return conductor beneath said bridge wherein said lower ground electrical conductor is patterned to produce uniform current density in said bridge.

* * * * *